US011965263B2

(12) United States Patent
Ötzlinger et al.

(10) Patent No.: US 11,965,263 B2
(45) Date of Patent: Apr. 23, 2024

(54) SUBSTRATE HOLDING AND LOCKING SYSTEM FOR CHEMICAL AND/OR ELECTROLYTIC SURFACE TREATMENT

(71) Applicant: SEMSYSCO GMBH, Salzburg (AT)

(72) Inventors: Herbert Ötzlinger, Hallwang (AT); Oliver Knoll, Salzburg (AT); Raoul Schröder, Neuenstein (DE); Markus Gersdorff, Salzburg (AT); Thomas Wirnsberger, Seeboden (AT); Georg Hofer, Stadl-Predlitz (AT); Andreas Gleissner, Stadl-Predlitz (AT)

(73) Assignee: SEMSYSCO GMBH, Salzburg (AT)

( * ) Notice: Subject to any disclaimer, the term of this patent is extended or adjusted under 35 U.S.C. 154(b) by 0 days.

(21) Appl. No.: 17/794,517

(22) PCT Filed: Sep. 2, 2020

(86) PCT No.: PCT/EP2020/074506
§ 371 (c)(1),
(2) Date: Jul. 21, 2022

(87) PCT Pub. No.: WO2021/148149
PCT Pub. Date: Jul. 29, 2021

(65) Prior Publication Data

US 2023/0053226 A1 Feb. 16, 2023

(30) Foreign Application Priority Data

Jan. 21, 2020 (EP) ..... 20152788

(51) Int. Cl.
*C25D 17/06* (2006.01)
*C25D 17/00* (2006.01)

(52) U.S. Cl.
CPC ..... *C25D 17/06* (2013.01); *C25D 17/004* (2013.01)

(58) Field of Classification Search
CPC ..... C25D 5/028; C25D 7/12–7/126; C25D 17/06; C25D 17/001
See application file for complete search history.

(56) References Cited

U.S. PATENT DOCUMENTS 6,892,769 B2 5/2005 Hong
9,464,362 B2 * 10/2016 Scanlan ..... H01L 21/68721
(Continued)

OTHER PUBLICATIONS

Office Action and English translation thereof issued in Japanese patent application No. 2022-533542 dated Feb. 7, 2023, 6 pages.
(Continued)

*Primary Examiner* — Alexander W Keeling
(74) *Attorney, Agent, or Firm* — Meunier Carlin & Curfman LLC

(57) ABSTRACT

The invention relates to a substrate holding and locking system for chemical and/or electrolytic surface treatment of a substrate in a process fluid and a corresponding method. The system comprises a first element, a second element, a reduced pressure holding unit and a magnetic locking unit. The first element and the second element are configured to hold the substrate between each other. The reduced pressure holding unit comprises a pump to reduce an interior pressure inside the substrate holding and locking system below atmospheric pressure. The magnetic locking unit is configured to lock the first element and the second element with each other. The magnetic locking unit comprises a magnet control and at least a magnet. The magnet is arranged at one of the first element and the second element. The magnet control is configured to control a magnetic force between the first element and the second element.

16 Claims, 9 Drawing Sheets

(56) References Cited

U.S. PATENT DOCUMENTS

| | | | | |
|---|---|---|---|---|
| 2008/0038839 | A1* | 2/2008 | Linder | B01L 3/0293 422/68.1 |
| 2015/0225868 | A1* | 8/2015 | Rauenbusch | C25D 17/001 204/297.02 |
| 2019/0032234 | A1 | 1/2019 | Gleissner et al. | |
| 2019/0390359 | A1 | 12/2019 | Seki et al. | |

OTHER PUBLICATIONS

Office Action and English translation thereof issued in Chinese patent application No. 202080093690.3 dated Jan. 20, 2023, 9 pages.
Office Action and English translation thereof issued in Korean patent application No. 9-5-2022-102144035 dated Dec. 28, 2022, 6 pages.
Office Action and English translation thereof issued in Taiwanese patent application No. 110115815 dated Jan. 9, 2023, 8 pages.
International Search Report and Written Opinion in International Application No. PCT/EP2020/074506, dated Jan. 15, 2021, 13 pages.
European Search Report in European Application No. 20152788.4, dated Jul. 23, 2020, 8 pages.
Extended European Search Report issued in European Application No. 22167592.9 dated May 30, 2022, 7 pages.
Office Action issued in European Application No. 20152788.4, dated Oct. 29, 2021, 5 pages.
Intention to Grant issued in European Application No. 20152788.4, dated Feb. 21, 2022, 37 pages.
Office Action and English translation thereof issued in Japense patent application No. JP2022-533542 dated Aug. 15, 2023, 6 pages.
Written Opinion issued in corresponding Singaporean patent application No. 11202205186P, completed Apr. 7, 2023, 6 pages.

* cited by examiner

SUBSTRATE HOLDING AND LOCKING SYSTEM FOR CHEMICAL AND/OR ELECTROLYTIC SURFACE TREATMENT

FIELD OF THE INVENTION

The invention relates to a substrate holding and locking system for chemical and/or electrolytic surface treatment of a substrate in a process fluid, and a substrate holding and locking method for chemical and/or electrolytic surface treatment of a substrate in a process fluid.

BACKGROUND OF THE INVENTION

In the semiconductor industry, various processes can be used to deposit or remove materials on or from the surface of wafers.

For example, electrochemical deposition (ECD) or electrochemical mechanical deposition (ECMD) processes can be used to deposit conductors, such as copper, on previously patterned wafer surfaces to fabricate device interconnect structures.

Chemical mechanical polishing (CMP) is commonly used for a material removal step. Another technique, electropolishing or electroetching, can also be used to remove excess materials from the surface of the wafers.

Electrochemical (or electrochemical mechanical) deposition of materials on wafer surfaces or electrochemical (or electrochemical mechanical) removal of materials from the wafer surfaces are collectively called "electrochemical processing". Electrochemical, chemical and/or electrolytic surface treatment techniques may comprise electropolishing (or electroetching), electrochemical mechanical polishing (or electrochemical mechanical etching), electrochemical deposition and electrochemical mechanical deposition. All techniques utilize a process fluid.

Chemical and/or electrolytic surface treatment techniques involve the following steps. A substrate to be processed is attached to a substrate holder, immersed into an electrolytic process fluid and serves as a cathode. An electrode is immersed into the process fluid and serves as an anode. A direct current is applied to the process fluid and dissociates positively charged metal ions at the anode. The ions then migrate to the cathode, where they plate the substrate attached to the cathode.

A handling of such chemical and/or electrolytic surface treatment of a substrate in a process fluid can be improved.

SUMMARY OF THE INVENTION

Hence, there may be a need to provide an improved system for chemical and/or electrolytic surface treatment of a substrate in a process fluid, which in particular improves a handling of the substrate.

This objective can solved by the subject-matters of the independent claims, wherein further embodiments are incorporated in the dependent claims. It should be noted that the aspects of the invention described in the following apply also to the substrate holding and locking system for chemical and/or electrolytic surface treatment of a substrate in a process fluid and the substrate holding and locking method for chemical and/or electrolytic surface treatment of a substrate in a process fluid.

According to the present invention, a substrate holding and locking system for chemical and/or electrolytic surface treatment of a substrate in a process fluid is presented.

The chemical and/or electrolytic surface treatment may be any material deposition, galvanized coating, chemical or electrochemical etching, anodal oxidation, metal separation or the like.

The substrate may comprise a conductor plate, a semiconductor substrate, a film substrate, an essentially plate-shaped, metal or metallized workpiece or the like. A surface of the surface to be treated may be at least partially masked or unmasked.

The substrate holding and locking system for chemical and/or electrolytic surface treatment comprises a first element, a second element, a reduced pressure holding unit and a magnetic locking unit.

The first element and the second element are configured to hold the substrate between each other. The first element may be a first contact ring and the second element may be a second contact ring. They may hold one substrate between each other, either for single or dual side surface treatment. The first element may also be a substrate holder and only the second element is a contact ring (in the following a so-called contact loop to distinguish this configuration). A second, different substrate may then be held on a rear side of the substrate holder.

The reduced pressure holding unit comprises a pump to reduce an interior pressure inside the substrate holding and locking system below atmospheric pressure. The interior pressure may be reduced just below atmospheric pressure and/or to vacuum.

The magnetic locking unit is configured to lock the first element and the second element with each other. The magnetic locking unit comprises a magnet control and at least a magnet. The magnet is arranged at one of the first element and the second element. The magnet control is configured to control a magnetic force between the first element and the second element. The magnet control may influence the magnetic force to open the magnetic locking unit and to release the substrate from the substrate holder.

As a result, the substrate holding and locking system according to the invention for chemical and/or electrolytic surface treatment of a substrate in a process fluid allows an easy handling of the substrate(s) and the substrate holder. No outside screws or the like are necessary. The substrate(s) can be very easily locked and hold by the substrate holder and unlocked and released. The procedure can be easily automated.

The reduced pressure or vacuum holding unit adds safety to the magnetic locking. The combination of reduced pressure holding and magnetic locking remains locked and tight even in case of e.g. increased manufacturing tolerances, decreased manufacturing quality, misalignment etc. and thereby avoids leakage.

As a result, the substrate(s) are very safely hold by the substrate holder, which eases e.g. a uniform material deposition during surface treatment, a transport of the substrate(s) in and protected by the substrate holder, etc. Consequently, the substrate holding and locking system according to the invention improves the entire surface treatment procedure.

Further, the substrate holding and locking system is very flexible, because it can be used to treat either one or two substrates and, when surface treating one substrate, it can be used for either single or dual side surface treatment.

In one case, the first element and the second element may be two contact rings holding one substrate between them. In this example, the first element is a first contact ring and the second element is a second contact ring, both configured to hold one substrate between each other. The first element and the second element may hold the single substrate either for single or dual side surface treatment. Even a surface treatment of passage holes or vias extending through the substrate is possible.

In another case, the first element may be a substrate holder and the second element may be a so-called contact loop. The contact loop may the same as a contact ring. The substrate holder may be configured to hold the substrate. The substrate holder may be configured to hold one (single or dual side surface treatment) or two substrates (one substrate on each side of the substrate holder). In that example, the first element is a substrate holder and the second element is a contact loop. The substrate holder and the contact loop are configured to hold one substrate between each other. This configuration might be more stable than the first case.

Further, this configuration can be used for a surface treatment of two substrates at the same time. In that example, the substrate locking system for chemical and/or electrolytic surface treatment of a substrate may further comprise an additional contact loop configured to hold an additional substrate between a reverse side of the substrate holder and the additional contact loop. The substrate holder may then hold two substrates, one on each side of the substrate holder.

The reduced pressure holding unit comprises a pump or vacuum source to reduce an interior pressure inside the substrate holding and locking system below atmospheric pressure. The wording "below atmospheric pressure" can be understood as a pressure of 750 mbar (75000 Pa) or less.

In an example, the pump is arranged outside the first element and the second element as an external pump. This means the pump can be arranged outside the substrate holder and its components (contact ring or contact loop) and can be connected to the interior of the substrate holder and its components by means of e.g. a pressure line and an interface at the substrate holder.

In another example, the pump is arranged at the first element and/or the second element as an internal pump. The pump may then control the interior pressure inside the substrate holder and its components also in case the substrate holding and locking system is surrounded by a liquid or fluid and/or in case of a passage between different handling modules. The wording "surrounded by a liquid or fluid" can be understood as immersed or submerged in a liquid or fluid , sprayed by a liquid or fluid and the like. The liquid or fluid can be understood as the process fluid, e.g. a plating electrolyte and the like. As a result, the substrate holding and locking system is autarkic to control the pressure situation inside the substrate holder and its components. The pump may maintain the reduced pressure in the interior of the substrate holder and its components independent of an external vacuum supply.

In still another example, the pump is arranged at the first element and/or the second element and an additional external reduced pressure system is arranged outside the first element and the second element. This means, the pump can be used as an internal pump to control the reduced pressure inside the substrate holder and its components in case the substrate holding and locking system is immersed or submerged to the process fluid and the additional external reduced pressure system can be used when the substrate holding and locking system is outside the process fluid. The pump and the additional external reduced pressure system can be similar in view of size, function and power.

However, the additional external reduced pressure system can also be dimensioned and used to achieve the reduced pressure inside the substrate holder and its components and the pump can only be dimensioned and used to control the already achieved reduced pressure inside the substrate holder and its components. As a result, the pump inside the substrate holder and its components can be smaller and/or less powerful than the additional external reduced pressure system, because the "main workload" of reducing pressure inside the substrate holder and its components is deferred to the stationary additional external reduced pressure system.

In an example, the reduced pressure holding unit further comprises an energy supply. The energy supply may be arranged at the first element and/or the second element.

The energy supply may provide energy to run the pump and/or to control the magnetic locking unit. In other words, the pump may be supplied with energy to keep the magnetic locking unit closed and/or to maintain a reduced pressure in the interior of the substrate holder and its components independent of an external energy supply, e.g. during an emergency stop. The energy supply may also provide energy for at least one of the following group: a data transmitter, a sensor unit, and a valve unit (see below). The energy supply may be at least one battery or rechargeable battery.

The energy supply may also be arranged outside the first element and the second element. This means the energy supply can be arranged outside the substrate holder and its components (contact ring or contact loop) and can be connected to the interior of the substrate holder and its components by means of e.g. an electric wire, induction etc. The energy supply may also provide energy to the additional external reduced pressure system or there can be an additional energy supply for the additional external reduced pressure system, which is also arranged outside the first element and the second element.

In an example, the reduced pressure holding unit further comprises a data transmitter to supply data to monitor and/or control the interior pressure. The data transmitter may be arranged at the first element and/or the second element. The data transmitter may be a sender or a receiver, e.g. an RFID sender or receiver. The other part of the sender or receiver can be arranged outside the substrate holder and its components (contact ring or contact loop) and can be e.g. wirelessly connected to the data transmitter arranged at the first element and/or the second element. The data transmitter may transmit data detected inside the substrate holder and its components (e.g. by means of a sensor unit) to a control unit outside the substrate holder and its components. The control unit may be a processor. The control unit may control the energy supply for at least one of the following group: the pump, the additional external reduced pressure system, a valve unit regulating a pressure inside the substrate holder and its components, and a sensor unit to provide data for the data transmitter (see below).

In an example, the reduced pressure holding unit further comprises a sensor unit to provide data for the data transmitter. The sensor unit may be arranged at the first element and/or the second element. The sensor unit may be a pressure sensor. The sensor unit may also comprise a temperature sensor, a humidity sensor and/or the like. A monitor unit may be arranged outside the first element and the second element. The sensor unit and the monitor unit allow a pressure monitoring of the substrate holding and locking system.

In an example, the reduced pressure holding unit further comprises a valve unit to implement a control of the interior pressure in the substrate holding and locking system. The valve unit may comprise at least a valve. The valve unit may be actuated to switch the reduced pressure on or off. The valve unit may be actuated to control the reduced pressure according to a current operation of the system. The valve unit may be actuated to vent a cover of the substrate holder. The valve unit may be actuated while loading and unloading the substrate. The valve unit may be actuated by the control unit. The valve unit may be actuated based on data detected inside the substrate holder and its components (e.g. by means of the sensor unit). The valve unit may be arranged at the first element and/or the second element. The valve unit may also be arranged outside the first element and the second element. This means the valve unit can be arranged outside the substrate holder and its components (contact ring or contact loop) and can be connected to the interior of the substrate holder and its components by means of e.g. a pressure line.

In an example, the magnet control is configured to control the magnetic force between the first element and the second element by applying a voltage. The magnet control may be a processor. In an example, the magnet control is configured to at least reduce the magnetic force of the permanent magnet to allow a release of the second element from the first element. In an example, the magnet control is configured to eliminate the magnetic force of the permanent magnet to allow a release of the second element from the first element. In an example, the magnet control is configured to reverse the magnetic force of the permanent magnet to allow a repelling of the second element relative to the first element. The magnet control may thereby allow an opening of the magnetic locking unit and a release of the substrate(s) from the substrate holder.

In an example, the magnet is a permanent magnet configured to lock the first element to the second element. In an example, the magnet of the magnetic locking unit is arranged at the first element. Of course, it can also be arranged at the second element. In an example, the magnetic locking unit comprises several magnets distributed at the first element along a substrate to be held. This may improve a uniformity and/or strength of the magnetic locking force.

The one of the first element and the second element, which does not comprise the magnet, may be magnetic. In case it is the second element, it may at least partially comprise a magnetic material. In this example, the second element may also be at least partially electrically conductive.

In case the substrate holder is configured to hold two substrates, the magnetic locking unit may be configured to switch the locking of both substrates on and off at the same time or independent of each other. In an example, the magnetic locking unit is therefore configured to simultaneously lock both contact loops and the substrate holder with each other. In another example, the magnetic locking unit is therefore configured to independently lock each contact loop and the substrate holder with each other.

The one of the first element and the second element, which does not comprise the magnet, may comprise at least a magnetic contact finger. In case it is the second element, the second element may comprise several contact fingers made of magnetic material. In a further example, the second element comprises several arrays of contact fingers to be arranged in contact with several magnets distributed at the first element.

In case it is the first element holding the magnet, the first element may comprise at least an electrical conductor rod extending along the first element. In an example, one end of the contact fingers contacts the magnet, which contacts the electrical conductor rod.

Of course, all what is said for one of the first element and the second element may also apply to the other of the first element and the second element in case the functions of the first element and the second element are exchanged. Of course, the first element and the second element can also be mixed so that e.g. each of the first element and the second element are magnetic and comprise magnets working together.

In an example, the substrate holding and locking system for chemical and/or electrolytic surface treatment of a substrate further comprises a sealing unit arranged between the first element and the second element. The sealing unit may be configured to ensure a liquid-tight connection between the substrate, the first element and the second element. In an example, the sealing unit comprises an inner sealing configured to ensure a liquid-tight connection between the substrate and the contact loop. In an example, the sealing unit comprises an outer sealing configured to ensure a liquid-tight connection between the substrate holder and the contact loop. The inner and/or the outer sealing may be replaceable.

According to the present invention, also a device for chemical and/or electrolytic surface treatment of a substrate in a process fluid is presented. The device for chemical and/or electrolytic surface treatment comprises a substrate holding and locking system as described above and a distribution body.

The distribution body is configured to direct a flow of the process fluid and/or an electrical current to the substrate. The distribution body may correspond to the substrate to be treated in particular in view of its shape and size. The distribution system may be a vertical distribution system with a vertical plating chamber, in which the substrate is inserted vertically. The distribution system may also be a horizontal distribution system with a horizontal plating chamber, in which the substrate is inserted horizontally.

The device for chemical and/or electrolytic surface treatment may further comprise a substrate holder. The substrate holder may be configured to hold the substrate. The substrate holder may be configured to hold one (single or dual side surface treatment) or two substrates (one substrate on each side of the substrate holder). The device for chemical and/or electrolytic surface treatment may further comprise one or two substrates.

The device for chemical and/or electrolytic surface treatment may further comprise an anode. The anode may be a multi-zone anode. Further, the device for chemical and/or electrolytic surface treatment may comprise a power supply. The device for chemical and/or electrolytic surface treatment may further comprise a process fluid supply.

According to the present invention, also a substrate holding and locking method for chemical and/or electrolytic surface treatment of a substrate in a process fluid is presented. The method for chemical and/or electrolytic surface treatment comprises the following steps, not necessarily in this order:

a) arranging a substrate between a first element and a second element,
b) locking the first element and the second element with each other by means of a magnetic locking unit,
c) reducing an interior pressure inside the substrate holding and locking system below atmospheric pressure by means of a pump of a reduced pressure holding unit.

The magnetic locking unit comprises a magnet control and at least a magnet. The magnet is arranged at one of the first element and the second element. The magnet control is configured to control a magnetic force between the first element and the second element.

The substrate holding and locking method according to the invention allows an easy handling of the substrate(s) and the substrate holder. In particular, the substrate(s) can be very easily locked and hold by the substrate holder and unlocked and released.

The systems, devices and methods according to the invention may be suitable for processing structured semi-conductor substrates, conductor plates, film substrates, an entire surface of planar metal and metallized substrates, etc. The systems, devices and methods may also be used for a production of large surface photoelectric panels for solar energy generation, large-scale monitor panels or the like.

It shall be understood that the system, the device, and the method for chemical and/or electrolytic surface treatment of a substrate in a process fluid according to the independent claims have similar and/or identical preferred embodiments, in particular, as defined in the dependent claims. It shall be understood further that a preferred embodiment of the invention can also be any combination of the dependent claims with the respective independent claim.

These and other aspects of the present invention will become apparent from and be elucidated with reference to the embodiments described hereinafter.

BRIEF DESCRIPTION OF THE DRAWINGS

Exemplary embodiments of the invention will be described in the following with reference to the accompanying drawings.

DETAILED DESCRIPTION OF EMBODIMENTS

Figure 1:
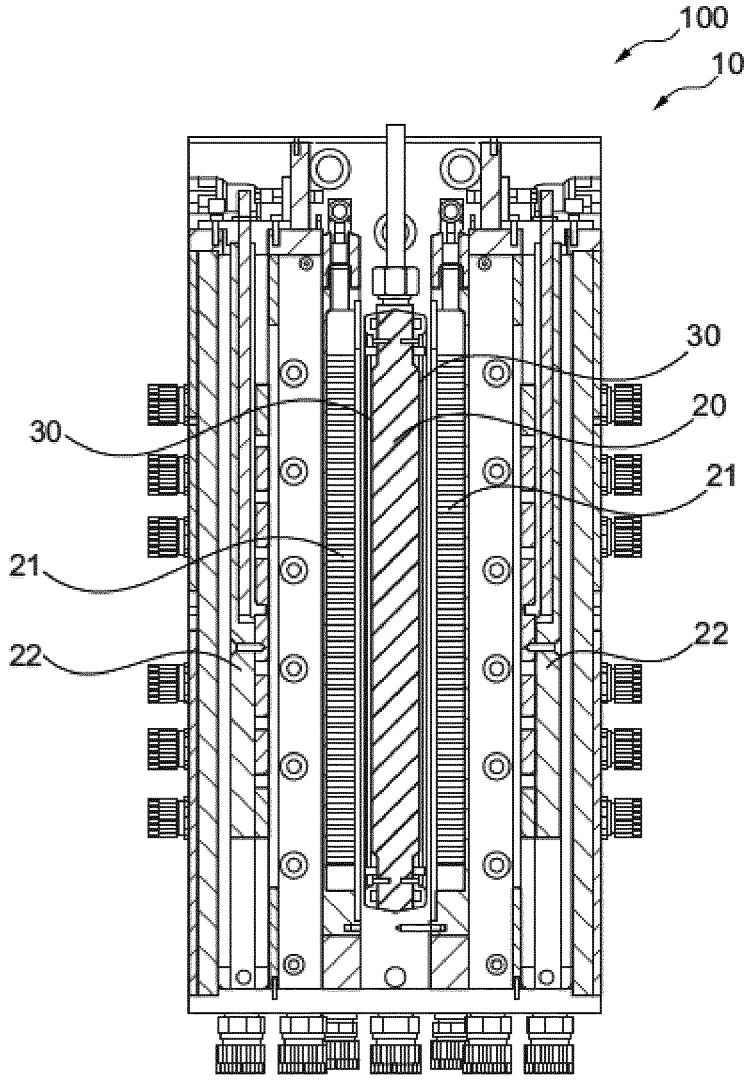
FIG. 1 shows schematically and exemplarily an embodiment of a device for chemical and/or electrolytic surface treatment of the substrate in the process fluid.

FIG. 1 shows schematically and exemplarily an embodiment of a device 100 for chemical and/or electrolytic surface treatment of a substrate 30 in a process fluid. The device 100 for chemical and/or electrolytic surface treatment comprises a substrate holding and locking system 10 for chemical and/or electrolytic surface treatment of here two substrates 30 in a process fluid. The substrates 30 are hold by a substrate holder 20.

Figure 2:
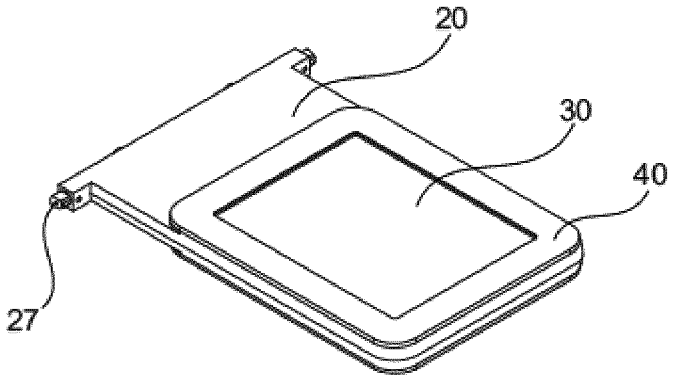
FIG. 2 shows schematically and exemplarily an embodiment of a substrate holder holding two substrates.
Figure 3:
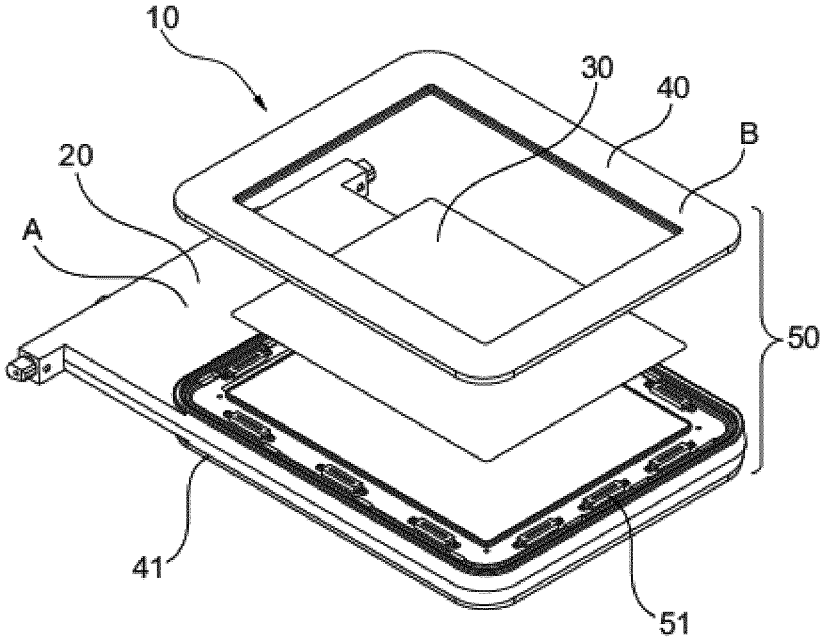
FIG. 3 shows schematically and exemplarily another embodiment of a substrate holding and locking system for chemical and/or electrolytic surface treatment of the substrate in the process fluid according to the invention.

FIG. 2 shows schematically and exemplarily an embodiment of the substrate holder 20. It is configured to hold one or two substrates 30, one substrate 30 on each side of the substrate holder 20. The substrate holder 20 here holds rectangular substrates 30 with rounded corners and a size of e.g. 370×470 mm. Of course, the device 100 for chemical and/or electrolytic surface treatment may also be used with a substrate holder, which is configured to hold only one substrate 30 for single or dual side surface treatment in a preferably horizontal arrangement.

The substrate 30 may be an essentially plate-shaped workpiece for the production of electric or electronic components, which is mechanically fixed in the substrate holder 20, and the surface of which to be treated is bathed in the process fluid as the treatment medium coming from a distribution body 21. In a special case, the substrate 30 may be a masked or unmasked conductor plate, a semi-conductor substrate, or a film substrate, or even any metal or metallized workpiece having an approximately planar surface.

Referring back to FIG. 1, the device 100 for chemical and/or electrolytic surface treatment further comprises a distribution body 21. The distribution body 21 produces targeted flow and current density patterns for the chemical and/or electrolytic surface treatment and is submerged in the process fluid (not shown). Opposite of each distribution body 21 is the substrate 30 that is attached to the substrate holder 20. The surface of the substrate 30 is wetted by the process fluid. The distribution body 21 comprises a plurality of distribution openings (not shown) directed of the substrate 30. The plurality of distribution openings comprise outlet openings to direct a flow of process fluid to the substrate 30 and/or backflow openings to receive a backflow of process fluid from the substrate 30. The substrate 30 acts as a counter electrode to the anode or, in other words, as a cathode. The distribution body 21 may advantageously comprise plastic, in particularly advantageous manner polypropylene, polyvinyl chloride, polyethylene, acrylic glass, i.e. polymethyl methacrylate, polytetrafluoroethylene, or another material that will not be decomposed by the process fluid.

The device 100 for chemical and/or electrolytic surface treatment further comprises anodes 22 that are each located on a side of one of the distribution bodies 21 opposite of the substrate 30 and are also bathed in the process fluid. Each anode 22 is attached in a rear region of the respective distribution body 21, in mechanical contact with, or spatially separated from, the distribution body 21 such that the electric current flow is carried out between the anode 22 and the substrate 30 acting as counter electrode within the process fluid. Depending on the surface treatment method used, the anode 22 may comprise a material that is insoluble in the process liquid, such as platinizized titanium, or otherwise a soluble material, such as for example, the metal to be galvanically separated.

FIGS. 3 to 6 show schematically and exemplarily embodiments of a substrate holding and locking system 10 for chemical and/or electrolytic surface treatment of the substrate 30 in the process fluid according to the invention. The substrate holding and locking system 10 comprises a first element A, a second element B, a reduced pressure holding unit (shown in FIGS. 10 and 11) and a magnetic locking unit 50.

The first element A and the second element B are configured to hold the substrate 30 between each other. The first element A is here the substrate holder 20 and the second element B is a contact ring or contact loop 40. The substrate holding and locking system 10 here further comprises an additional contact loop 41 holding an additional substrate 30 between a reverse side of the substrate holder 20 and the additional contact loop 41 (see also a more detailed cross section in FIG. 5). The substrate holder 20 then holds two substrates 30, one on each side of the substrate holder 20.

The magnetic locking unit 50 is configured to lock the first element A, the substrate holder 20, and the second element B, the contact loop 40, with each other. The magnetic locking unit 50 comprises a magnet control (not shown) and several magnets 51 arranged at and distributed along the first element A, the substrate holder 20. The magnet control controls a magnetic force between the first element A, the substrate holder 20, and the second element B, the contact loop 40, to close, lock and hold the substrate 30 or to unlock, open and release the substrate 30 from the substrate holder 20. As a result, the substrate holding and locking system 10 according to the invention allows a very easy and flexible handling of the substrate 30 and the substrate holder 20.

The magnets 51 are here permanent magnets distributed along the substrate holder 20, while the contact loop 40 is made of a magnetic material. The magnet control controls the magnetic force between the first element A (substrate holder 20) and the second element B (contact loop 40) by applying a voltage.

Figure 4:
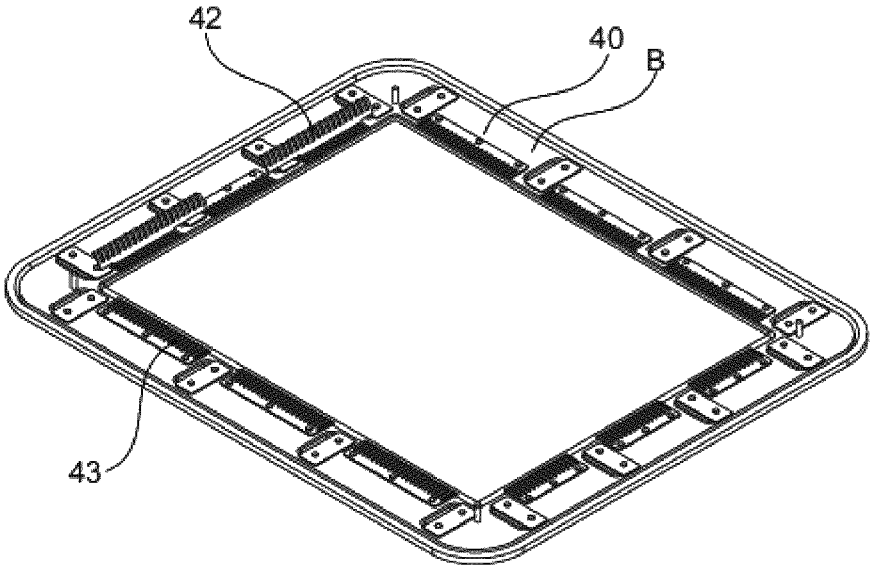
FIG. 4 shows schematically and exemplarily an embodiment of the second element.

FIG. 4 shows schematically and exemplarily an embodiment of the second element B, which is here the contact loop 40. The contact loop 40 comprises several arrays of magnetic contact fingers 42, which will be, in a closed configuration, in contact with the magnets 51 distributed along the substrate holder 20. The contact fingers 42 are here upright or standing. The contact loop 40 further comprises several arrays of contact fingers 43, which will be in contact with the substrate 30 and may therefore be planar or lying.

Figure 5:
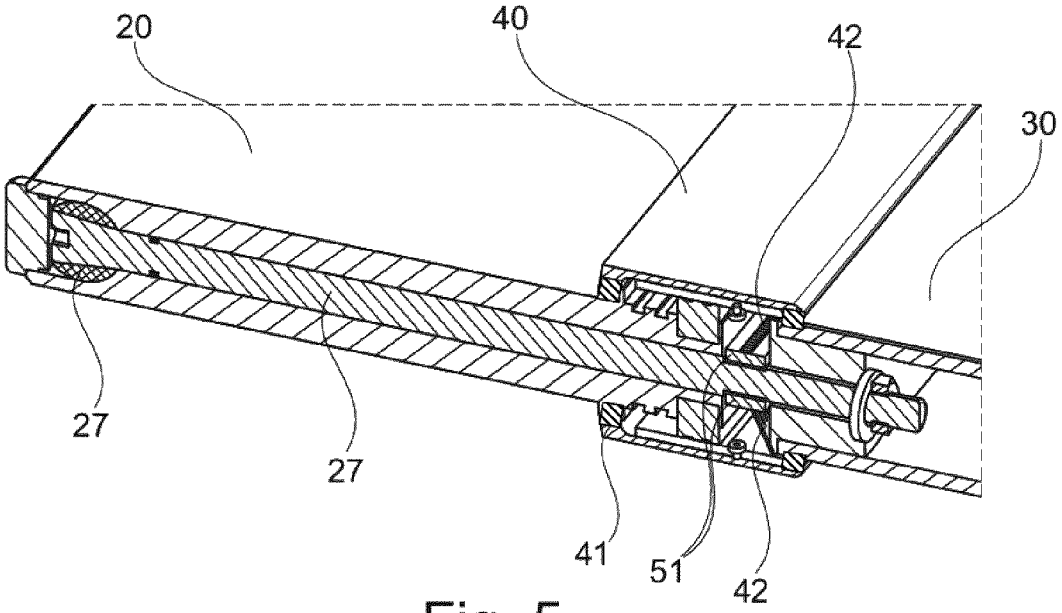
FIG. 5 shows schematically and exemplarily a cross section of a portion of the substrate holder as shown in FIG. 2.

FIG. 5 shows schematically and exemplarily a cross section of a portion of the substrate holder 20 as shown in FIG. 2. So-called electrical conductor rods 27 at least partially extend along at least some of the four edges of the substrate holder 20. Here, a first conductor rod 27 extends along a longer side of the substrate holder 20 and meets in a corner a second conductor rod 27 extending along a shorter side of the substrate holder 20. A free end of the contact finger array 42 contacts the magnet 51 at the substrate holder 20, which contacts the electrical conductor rod 27.

Figure 6:
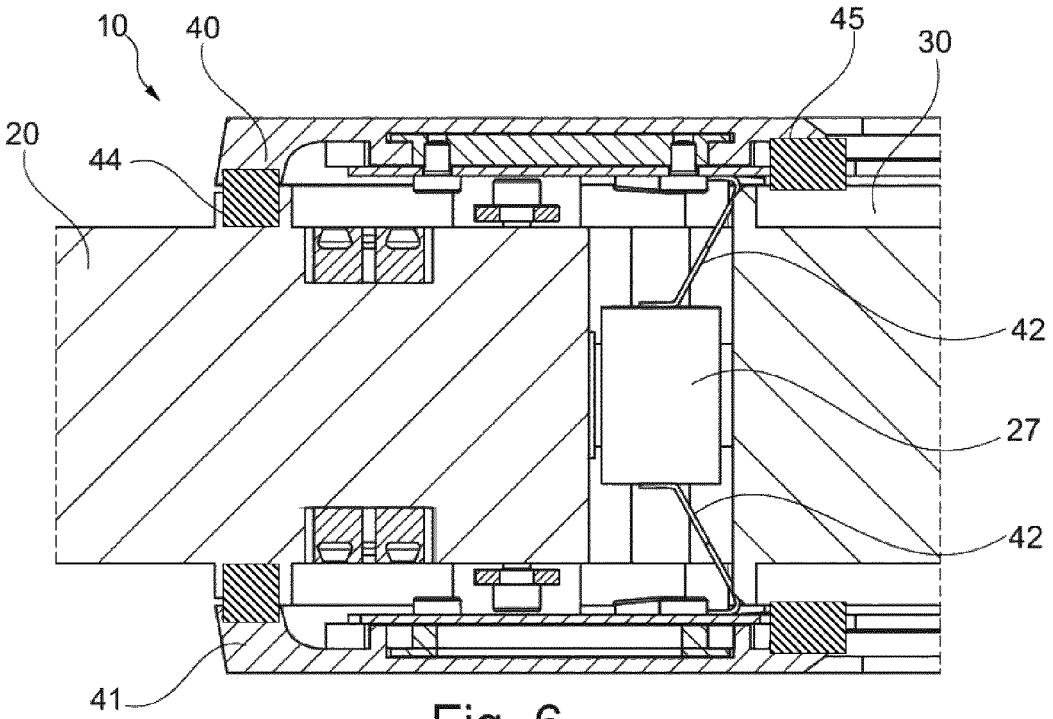
FIG. 6 shows schematically and exemplarily an even closer cross-section of a portion of the substrate holding and locking system according to the invention.

FIG. 6 shows schematically and exemplarily an even closer cross-section of a portion of the substrate holding and locking system 10. It further comprises a sealing unit 44, 45. The sealing unit comprises an outer sealing 44, which sits between the contact loop 40 and the substrate holder 20 and ensures a liquid-tight connection between the first element A and the second element B. The substrate holding and locking system 10 further comprises an inner sealing 45, which sits between the contact loop 40 and the substrate 30 and ensures a liquid-tight connection between the substrate 30 and the second element B.

Figure 7:
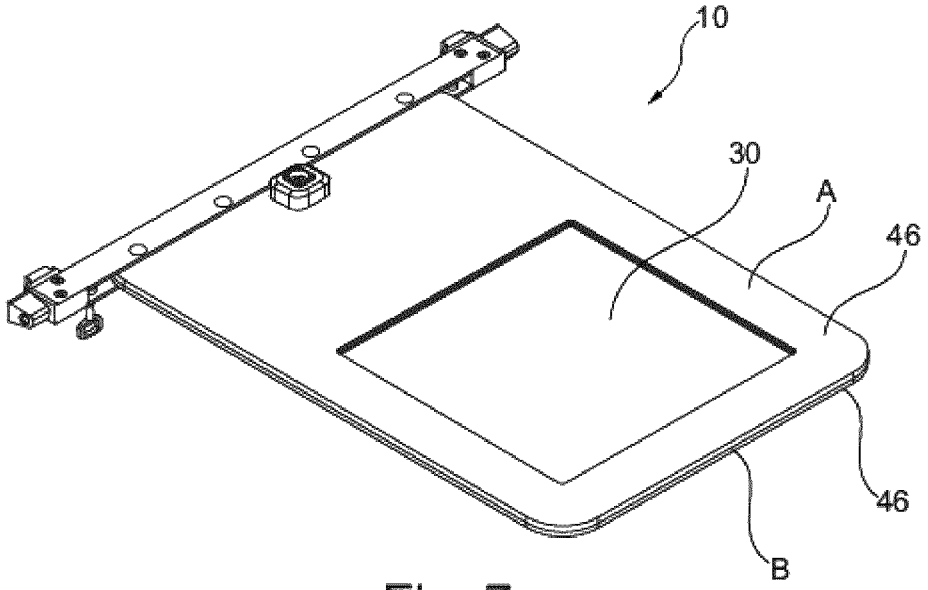
FIG. 7 shows schematically and exemplarily a further embodiment of a substrate holding and locking system for chemical and/or electrolytic surface treatment of the substrate in the process fluid according to the invention.
Figure 8:
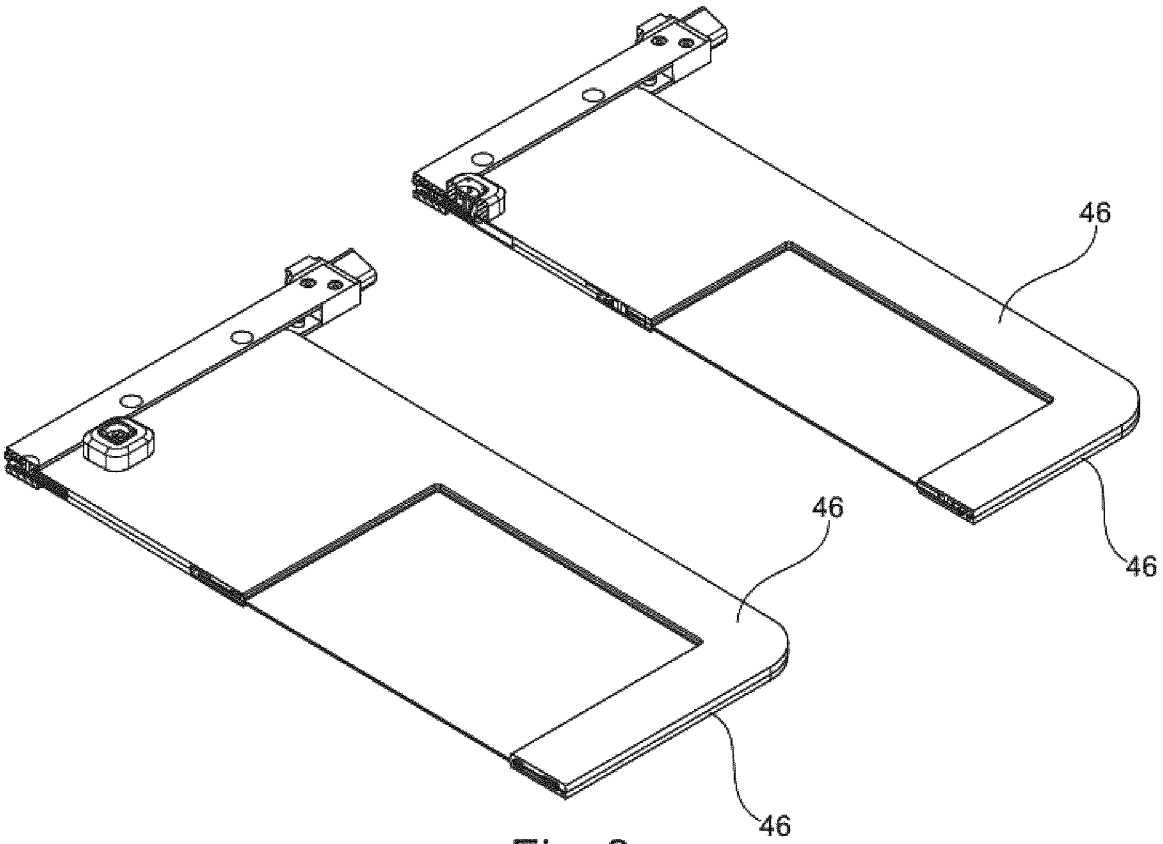
FIG. 8 shows different views of the further embodiment of a substrate holding and locking system of FIG. 7.
Figure 9:
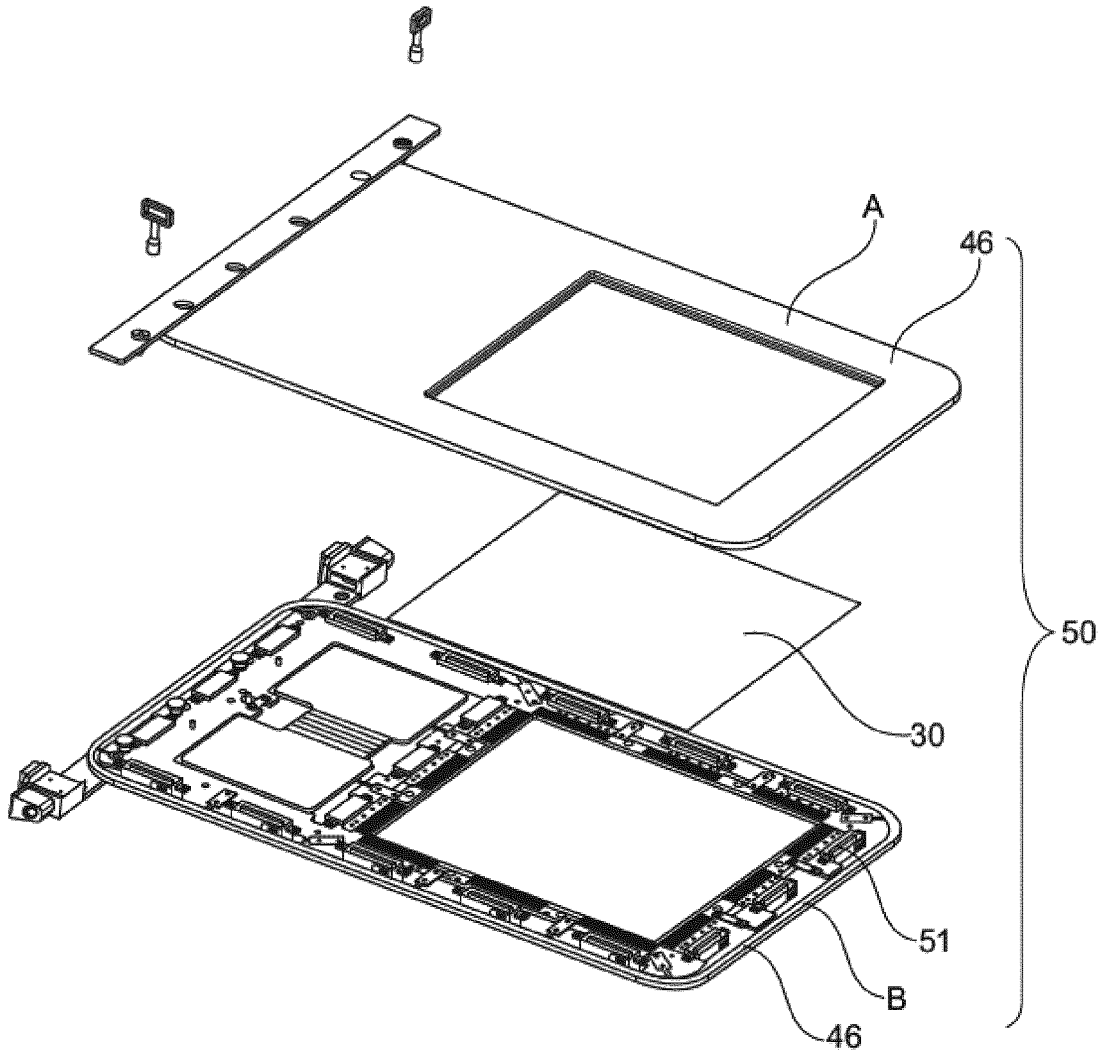
FIG. 9 shows schematically and exemplarily an exploded view of the embodiment of FIGS. 7 and 8.

FIGS. 7 to 9 show schematically and exemplarily further embodiments of a substrate holding and locking system 10 for chemical and/or electrolytic surface treatment of the substrate 30 according to the invention. The substrate holding and locking system 10 comprises a first element A, a second element B, a reduced pressure holding unit (shown in FIGS. 10 and 11) and a magnetic locking unit 50.

The first element A and the second element B are here two contact rings 46 holding one substrate 30 between them. There is no substrate holder. The two contact rings 46 here hold a single substrate 20 for dual side surface treatment. The two contact rings 46 are therefore provided with a recess to make the substrate 20 accessible from both sides.

The magnetic locking unit 50 locks the first element A and the second element B with each other. The magnetic locking unit 50 comprises a magnet control (not shown) and several magnets 51 arranged at and distributed along the first element A, one of the two contact rings 46. The magnet control controls a magnetic force between the two contact rings 46 as first element A and second element B to close, lock and hold the substrate 30 or to unlock, open and release the substrate 30. As a result, the substrate locking system 10 according to the invention allows a very easy and flexible handling of the substrate 30.

The magnets 51 are here permanent magnets distributed along one of the contact rings 46, while the other of the contact rings 46 is made of a magnetic material. The magnet control controls the magnetic force between the contact rings 46 by applying a voltage.

Figure 10:
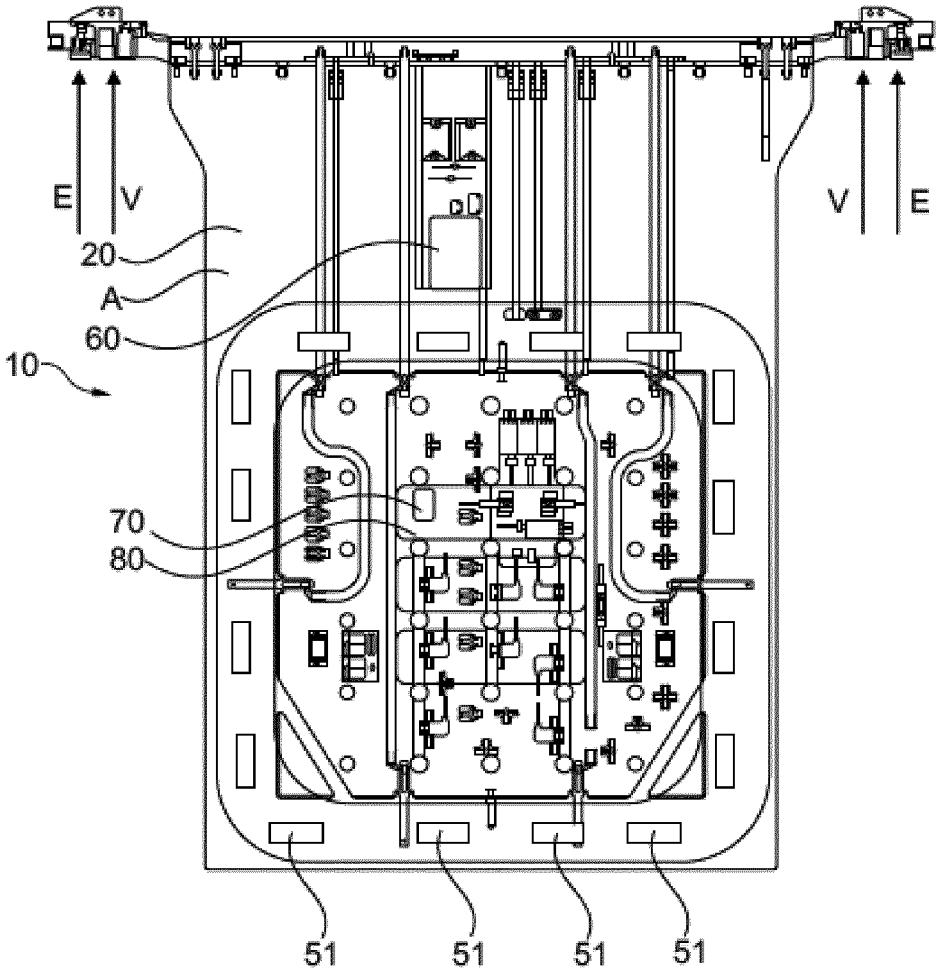
FIG. 10 shows schematically and exemplarily an embodiment of a substrate holding and locking system for chemical and/or electrolytic surface treatment of the substrate in the process fluid according to the invention.
Figure 11:
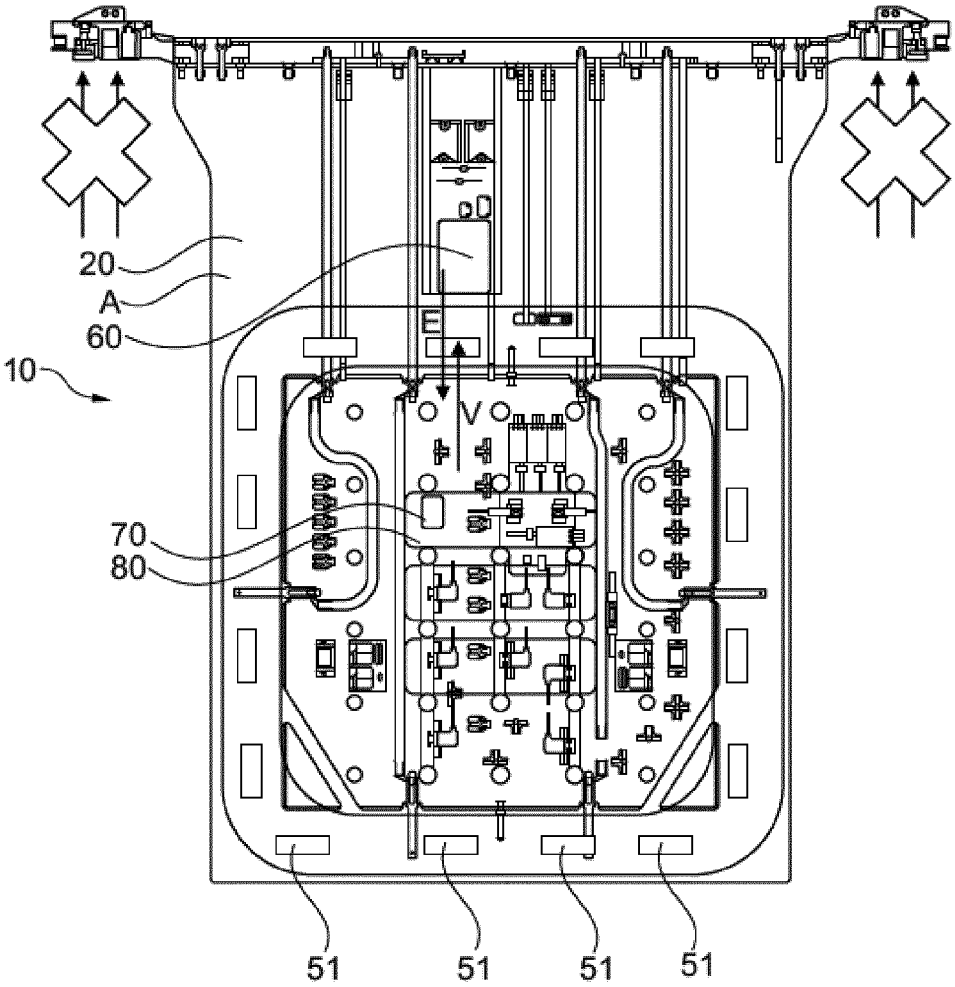
FIG. 11 shows schematically and exemplarily an embodiment of a substrate holding and locking system for chemical and/or electrolytic surface treatment of the substrate in the process fluid according to the invention.

FIGS. 10 and 11 show schematically and exemplarily embodiments of a substrate holding and locking system 10 for chemical and/or electrolytic surface treatment of the substrate 30 in the process fluid according to the invention. It is shown a substrate holder 20 as first element A, magnets 51 of the magnetic locking unit and a reduced pressure holding unit. The reduced pressure holding unit comprises a pump 80 to reduce an interior pressure inside the substrate holding and locking system 10 below atmospheric pressure and optionally to vacuum. The pump 80 is arranged at the substrate holder 20 or first element A.

An additional external reduced pressure system (not shown) is arranged outside the substrate holder 20. The additional external reduced pressure system can be used to reduce the pressure inside the substrate holder 20 and its components as shown by the arrows V in FIG. 10. The pump 80 can be used to control the already achieved reduced pressure inside the substrate holder 20 and its components as shown by the arrow V in FIG. 11. The pump 80 then controls the interior pressure inside the substrate holder 20 and its components also in case the substrate holding and locking system 10 is surrounded by the process fluid and/or in case of a passage between different handling modules. As a result, the pump 80 maintains the reduced pressure in the interior of the substrate holder 20 and its components independent of an external vacuum supply.

The reduced pressure holding unit further comprises an energy supply 60. The energy supply is e.g. a battery and arranged at the substrate holder 20 as first element A. The energy supply 60 provides energy to the substrate holder 20, as shown by the arrow E in FIG. 11. The energy supply 60 here provides energy to run the pump 80, to control the magnets 51 of the magnetic locking unit, and to provide energy to a data transmitter 70. The energy supply 60 thereby supplies energy to keep the magnetic locking unit closed and to maintain a reduced pressure in the interior of the substrate holder 20 and its components independent of an external energy supply. The energy supply 60 then provides energy also in case the substrate holding and locking system 10 is surrounded by the process fluid and/or in case of a passage between different handling modules.

The external energy supply E by the additional external reduced pressure system is closed in FIG. 11 in contrast to FIG. 10.

The energy supply 60 reduced pressure holding unit further comprises a data transmitter 70 to supply data to monitor and/or control the interior pressure. The data transmitter 70 is arranged at the substrate holder 20 as first element A. The data transmitter 70 may be an (RFID) sender or receiver. The other part of the sender or receiver can be arranged outside the substrate holder 20 and its components and can be e.g. wirelessly connected to the data transmitter 70 arranged inside the substrate holder 20 and its components. The data transmitter 70 transmits data detected inside the substrate holder 20 and its components (e.g. by means of a sensor unit) to a control unit outside the substrate holder 20.

Figure 12:
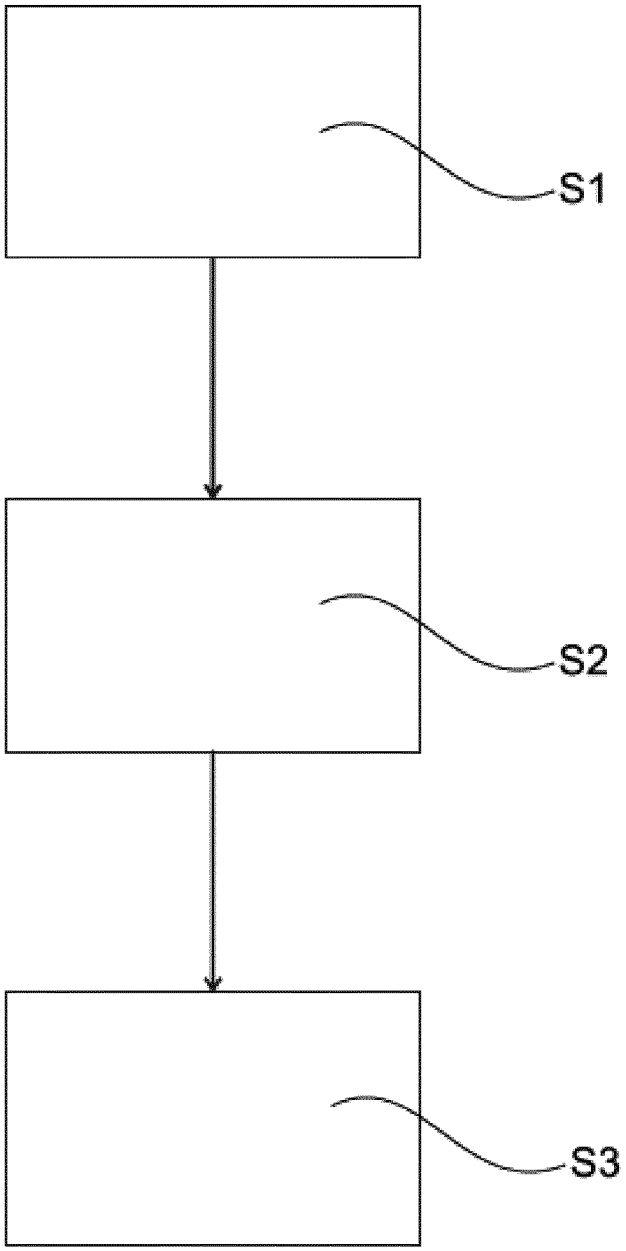
FIG. 12 shows basic steps of an example of a distribution method for chemical and/or electrolytic surface treatment of a substrate in a process fluid according to the invention.

FIG. 12 shows a schematic overview of steps of a method for chemical and/or electrolytic surface treatment of a substrate 30 in a process fluid. The method for chemical and/or electrolytic surface treatment comprises the following steps:

In a first step S1, arranging a substrate 30 between a first element A and a second element B.

In a second step S2, locking the first element A and the second element B with each other by means of a magnetic locking unit 50.

In a third step S3, reducing an interior pressure inside the substrate holding and locking system below atmospheric pressure by means of a pump of a reduced pressure holding unit.

The magnetic locking unit 50 comprises a magnet control and at least a magnet 51. The magnet 51 is arranged at one of the first element A and the second element B. The magnet control is configured to control a magnetic force between the first element A and the second element B.

The systems and methods are suitable, in particular, for the processing of structured semi-conductor substrates, conductor plates, and film substrates, but also for processing of the entire surface of planar metal and metallized substrates. System and method may also be used according to the invention for the production of large surface photoelectric panels for solar energy generation, or large-scale monitor panels.

It has to be noted that embodiments of the invention are described with reference to different subject matters. In particular, some embodiments are described with reference to method type claims whereas other embodiments are described with reference to the system type claims. However, a person skilled in the art will gather from the above and the following description that, unless otherwise notified, in addition to any combination of features belonging to one type of subject matter also any combination between features relating to different subject matters is considered to be disclosed with this application. However, all features can be combined providing synergetic effects that are more than the simple summation of the features.

While the invention has been illustrated and described in detail in the drawings and foregoing description, such illustration and description are to be considered illustrative or exemplary and not restrictive. The invention is not limited to the disclosed embodiments. Other variations to the disclosed embodiments can be understood and effected by those skilled in the art in practicing a claimed invention, from a study of the drawings, the disclosure, and the dependent claims.

In the claims, the word "comprising" does not exclude other elements or steps, and the indefinite article "a" or "an" does not exclude a plurality. A single processor or other unit may fulfil the functions of several items re-cited in the claims. The mere fact that certain measures are re-cited in mutually different dependent claims does not indicate that a combination of these measures cannot be used to advantage. Any reference signs in the claims should not be construed as limiting the scope.

The invention claimed is:

1. A substrate holding and locking system for chemical and/or electrolytic surface treatment of a substrate in a process fluid, comprising:

a first element, a second element, a magnetic locking unit, and a reduced pressure holding unit, wherein the first element and the second element are configured to hold the substrate between each other, wherein the magnetic locking unit is configured to lock the first element and the second element with each other, wherein the magnetic locking unit comprises a magnet control and at least a magnet, wherein the magnet is a permanent magnet and is arranged at one of the first element and the second element, wherein the magnet control is configured to control a magnetic force between the first element and the second element and to eliminate the magnetic force of the permanent magnet to allow a release of the second element relative to the first element, and wherein the reduced pressure holding unit comprises a pump to reduce an interior pressure inside the substrate holding and locking system below atmospheric pressure.

2. A system according to claim 1, wherein the reduced pressure holding unit further comprises an energy supply for the pump, wherein the energy supply is arranged at the first element and/or the second element.

3. A system according to claim 1, wherein the reduced pressure holding unit further comprises a data transmitter to supply data to control the interior pressure, wherein the data transmitter is arranged at the first element and/or the second element.

4. A system according to claim 3, wherein the reduced pressure holding unit further comprises a sensor unit to provide data for the data transmitter, wherein the sensor unit is arranged at the first element and/or the second element.

5. A system according to claim 1, wherein the reduced pressure holding unit further comprises a valve unit to implement a control of the interior pressure in the substrate holding and locking system, wherein the valve unit is arranged at the first element and/or the second element.

6. A system according to claim 1, wherein the first element is a first contact ring and the second element is a second contact ring, both configured to hold one substrate between each other.

7. A system according to claim 1, wherein the first element is a substrate holder and the second element is a contact loop, both configured to hold one substrate between each other.

8. A system according to claim 7, further comprising an additional contact loop configured to hold an additional substrate between a reverse side of the substrate holder and the additional contact loop.

9. A system according to claim 1, wherein the magnetic locking unit comprises several permanent magnets distributed at the first element along the substrate to be held, and wherein the second element at least partially comprises a magnetic material.

10. A system according to claim 1, wherein the magnet control is configured to control the magnetic force between the first element and the second element by applying a voltage.

11. A system according to claim 8, further comprising a sealing unit arranged between the first element and the second element and configured to ensure a liquid-tight connection between the substrate, the first element and the second element, wherein the sealing unit comprises an inner sealing configured to ensure a liquid-tight connection between the substrate and the contact loop and an outer sealing configured to ensure a liquid-tight connection between the substrate holder and the contact loop.

12. A system according to claim 9, wherein the magnetic locking unit is configured to simultaneously lock both contact loops and the substrate holder with each other or to independently lock each contact loop and the substrate holder with each other.

13. A substrate holding and locking method for chemical and/or electrolytic surface treatment of a substrate in a process fluid, comprising the following steps:

arranging a substrate between a first element and a second element, and locking the first element and the second element with each other by means of a magnetic locking unit, and reducing an interior pressure inside the substrate holding and locking system below atmospheric pressure by means of a pump of a reduced pressure holding unit, wherein the magnetic locking unit comprises a magnet control and at least a magnet, wherein the magnet is a permanent magnet and is arranged at one of the first element and the second element, wherein the magnet control is configured to control a magnetic force between the first element and the second element, and to eliminate the magnetic force of the permanent magnet to allow a release of the second element relative to the first element.

14. A system according to claim 1, wherein the pump is arranged at the first element and/or the second element to control the interior pressure in case the substrate holding and locking system is surrounded by the process fluid.

15. A system according to claim 1, wherein the magnet control is further configured to control the magnetic force to repel the second element relative to the first element.

16. A method according to claim 13, wherein the magnet control is further configured to control the magnetic force to repel the second element relative to the first element.

* * * * *